US009993079B1

(12) United States Patent
Scott

(10) Patent No.: US 9,993,079 B1
(45) Date of Patent: Jun. 12, 2018

(54) HAIR-STYLING CHAIR SYSTEM

(71) Applicant: Marilyn Rene Scott, Lancaster, TX (US)

(72) Inventor: Marilyn Rene Scott, Lancaster, TX (US)

( * ) Notice: Subject to any disclaimer, the term of this patent is extended or adjusted under 35 U.S.C. 154(b) by 38 days.

(21) Appl. No.: 15/290,041

(22) Filed: Oct. 11, 2016

Related U.S. Application Data

(60) Provisional application No. 62/243,406, filed on Oct. 19, 2015.

(51) Int. Cl.

| | |
|---|---|
| ***A47C 15/00*** | (2006.01) |
| ***A47C 1/11*** | (2006.01) |
| ***A47C 1/06*** | (2006.01) |
| ***A47C 7/50*** | (2006.01) |
| ***A47C 7/54*** | (2006.01) |
| ***A47C 7/68*** | (2006.01) |
| ***A47C 7/40*** | (2006.01) |
| ***A47C 3/18*** | (2006.01) |
| ***A47C 3/20*** | (2006.01) |
| ***A61H 1/00*** | (2006.01) |

(52) U.S. Cl.
CPC ..... *A47C 1/11* (2013.01); *A47C 1/06* (2013.01); *A47C 3/18* (2013.01); *A47C 3/20* (2013.01); *A47C 7/40* (2013.01); *A47C 7/50* (2013.01); *A47C 7/54* (2013.01); *A47C 7/68* (2013.01); *A61H 1/005* (2013.01); *A61H 2205/081* (2013.01); *A61H 2205/12* (2013.01)

(58) Field of Classification Search
CPC .... A47C 1/11; A47C 1/06; A47C 1/04; A47C 1/08; A47C 3/18; A47C 3/20; A47C 7/40; A47C 7/50; A47C 7/54; A47C 7/68; A61H 1/005; A61H 2205/081; A61H 2205/12
USPC ..... 297/240, 243, 232, 233, 235, 257
See application file for complete search history.

(56) References Cited

U.S. PATENT DOCUMENTS

| | | | | |
|---|---|---|---|---|
| 1,352,409 | A * | 9/1920 | Hoefener | A47C 1/08 297/241 |
| 1,361,446 | A * | 12/1920 | Conner | A47C 1/06 15/265 |
| 1,686,464 | A | 10/1928 | Lyman | |
| 1,773,504 | A | 8/1930 | Stokes | |
| 2,252,137 | A | 8/1941 | Rummerfield | |
| 2,446,376 | A * | 8/1948 | Littlejohn | A47C 1/08 297/241 |
| 2,553,545 | A | 5/1951 | Booth | |
| 4,372,605 | A | 2/1983 | Cervantes | |
| 4,863,217 | A * | 9/1989 | Fountain | A47C 1/08 108/13 |
| 5,437,495 | A * | 8/1995 | Wu | A47C 1/06 297/240 |
| 5,496,090 | A * | 3/1996 | Emmett | A47C 1/06 297/240 |

(Continued)

FOREIGN PATENT DOCUMENTS

DE 29508287 U1 4/1997

*Primary Examiner* — Mark R Wendell

(57) ABSTRACT

A salon styling chair includes a swiveling client chair and a stylist chair. The swiveling client chair is able to move up and down and rotate independent of the stylist chair. The stylist chair is able to move up and down and rotate independent of the swiveling client chair. A distance between the swiveling client chair and the stylist chair is able to be adjusted.

9 Claims, 7 Drawing Sheets

(56) References Cited

U.S. PATENT DOCUMENTS

| | | | | |
|---|---|---|---|---|
| 5,620,230 | A * | 4/1997 | Wu | A47C 1/06 248/405 |
| 6,851,748 | B1 * | 2/2005 | Garrick | A47C 1/03 248/429 |
| D651,423 | S | 1/2012 | Petruccelli | |
| 8,544,943 | B2 | 10/2013 | Fields | |
| 2007/0267903 | A1 * | 11/2007 | Hasimi | A47C 1/08 297/195.11 |

* cited by examiner

HAIR-STYLING CHAIR SYSTEM

CROSS REFERENCES TO RELATED APPLICATIONS

This application claims benefit of priority from U.S. Provisional Application Ser. No. 62/243,406, filed on Oct. 19, 2015, the entire contents of which are incorporated herein by reference.

STATEMENT REGARDING FEDERALLY SPONSORED RESEARCH

Not Applicable

REFERENCE TO APPENDIX

Not Applicable

FIELD OF THE INVENTION

The present invention relates to a stylist chair and, more specifically, to a stylist chair configured to seat both a client and a stylist with provisions to adjust the horizontal, vertical, and angular geometry of the stylist relative to the client.

BACKGROUND OF THE INVENTION

A common arrangement in a barber shop or styling salon is for the client to be seated in a stylist chair, barber chair, or salon chair while the stylist, barber, or beautician stands next to the client chair to perform their duties. This can be problematic for the stylist for a number of reasons. During the workday the stylist may be standing on a hard floor and therefore subjected to foot, ankle, and leg strain. The stylist may have to change the vertical height of each client several times and may incur neck strain as they adjust from trying to view the top of a client's head to trying to trim the beard on the underside of a client's chin. Depending upon the specific mechanism available repetitive motions may be required to adjust the height of the client chair and it is possible that back, shoulder, and arm strain might result. The stylist may be constantly moving back and forth between the client chair and a nearby counter to acquire different tools such as clippers, guards, combs, brushes, mirrors, and hair products as they are needed.

SUMMARY OF INVENTION

An object of the present invention is to provide comfortable seating for both a client and a stylist and to allow for easy adjustment of the horizontal, vertical, and angular geometry of the stylist relative to the client.

Another object of the present invention is to minimize the number of control points necessary to reconfigure the geometry of the stylist relative to the client.

Another object of the present invention is to provide a convenient, reconfigurable workspace for stylist tools and accessories.

Another object of the present invention is to enhance the comfort of the client.

These together with additional objects, features and advantages of the Dual Salon Styling Chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the Dual Salon Styling Chair in detail, it is to be understood that the Dual Salon Styling Chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the Dual Salon Styling Chair.

It is therefore important that the claims be regarded as including such equivalent construction insofar as they do not depart from the spirit and scope of the Dual Salon Styling Chair. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7.

Figure 1:
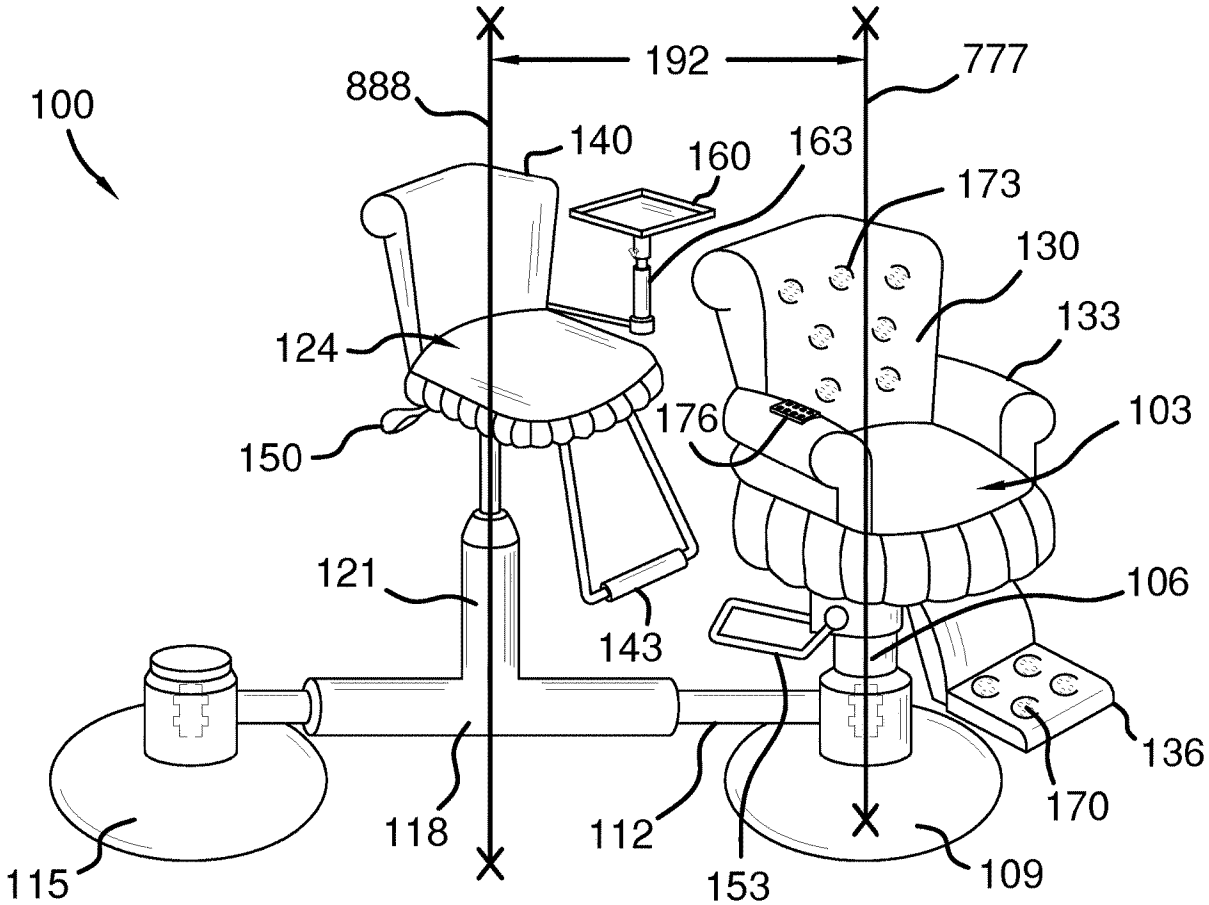
FIG. 1 is a perspective view of an embodiment of the disclosure.

Turning now to FIG. 1, the Dual Salon Styling Chair 100 (hereinafter invention) comprises a swiveling client chair 103, a first mounting base 109, a second mounting base 115, and a stylist chair 124. The first mounting base 109 and the second mounting base 115 are adapted to interface with a support surface 555.

A client vertical motion mechanism 106 is positioned above the first mounting base 109. A horizontal travel arm 112 extends laterally from the first mounting base 109. The horizontal travel arm 112 interfaces with a horizontal motion mechanism 118. The horizontal travel arm 112 connects over to the second mounting base 115. The horizontal motion mechanism 118 is able to slide back and forth with respect to the horizontal travel arm 112. The horizontal travel arm 112 connects between the first mounting base 109 and the second mounting base 115.

A stylist vertical motion mechanism 121 extends vertically from the horizontal motion mechanism 118. The stylist vertical motion mechanism 121 extends vertically to support the stylist chair 124.

In operation, the horizontal, vertical, and angular geometry of the stylist chair 124 relative to the swiveling client chair 103 can be adjusted. Moreover, the vertical and angular orientation of the stylist chair 124 and/or the swiveling client chair 103 is able to be adaptively adjusted with respect to the support surface 555.

The vertical geometry between stylist and client can be modified via raising or lowering the swiveling client chair 103 (via the client vertical motion mechanism 106), the stylist chair 124 (via using the stylist vertical motion mechanism 121), or both (either in the same or opposing directions). The horizontal geometry between stylist and client can be modified via moving the stylist chair closer or farther away (by using the horizontal motion mechanism 118). The swiveling client chair 103 is able to rotate about a client axis 777. The stylist chair 124 is able to rotate about a stylist axis 888. It shall be noted that the swiveling client chair 103 rotates about the client axis 777 independent of the rotation of the stylist chair 124 about the stylist axis 888.

A distance 192 between the stylist chair 124 and the swiveling client chair 103 is able to be adjusted via the horizontal motion mechanism 118. Moreover, the distance 192 spans from the client axis 777 to the stylist axis 888.

In some embodiments, the client vertical motion mechanism 106, the horizontal motion mechanism 118, and the stylist vertical motion mechanism 121 may be hydraulically operated using hydraulic fluid, compressed air, or another suitably compressible fluid. In some embodiments of the invention, the client vertical motion mechanism 106, the horizontal motion mechanism 118, and the stylist vertical motion mechanism 121 may be electrically operated using rotary motors, linear motors, electromagnetic repulsion, or other suitable electrical means. In some embodiments of the invention the motion mechanisms 106, 118, and 121 may use a combination of hydraulic and electrical operation. For example, in a certain embodiment, the vertical and horizontal motions of the stylist chair 124 may be electrically operated while the vertical motion of the client chair may be hydraulically operated.

In some embodiments of the invention 100, the motion mechanisms 106, 118, and 121 may be manually controlled using a paddle, lever, foot actuator, or other suitable actuators and may require horizontal, vertical, or rotary motion of the actuator, pumping motions, or constant pressure to effect change in the position of the associated mechanism. In some embodiments, the motion mechanisms 106, 118, and 121 may be automatically controlled using buttons, knobs, paddles, joysticks, touch panels, or other suitable interfaces.

Exemplary of how the various motions of the invention 100 may be controlled, consider that in certain embodiments of the invention a paddle 150 may control the motion of the stylist chair 124 up and down (by pulling the paddle up or pushing it down) and the motion of the stylist 445 towards the client 444 or away from the client 444 (by pushing the paddle towards the client 444 or away from the client 444). In some embodiments of the invention 100, a foot actuator 153 may control the motion of the swiveling client chair 103 up and down (for example, by pumping the foot actuator to raise the swiveling client chair 103 or by pressing all the way down on the foot actuator to lower the swiveling client chair 103). In another exemplary embodiment of the invention 100, a twisting motion of the paddle 150 might be used as an alternative way to raise or lower the stylist chair 124 in addition to controlling the motion of the stylist chair 124 when pushed or pulled as described above.

In some embodiments, the client chair 103 may provide a back support 130, armrests 133, and a foot support 136.

In some embodiments the stylist chair 124 may provide a back support 140, optional armrests (not shown in the figures and frequently not used to avoid constraining the stylist's movements), and a foot support 143.

In certain embodiments, the stylist chair may provide a tray 160 and a tray arm 163 upon which the stylist may place clippers, scissors, combs, and other tools and hair products that are not currently being used. In some embodiments, the tray arm 163 may be capable of swiveling from one side of the stylist chair 124 to the other side of the stylist chair to accommodate both left and right-handed stylists. In some embodiments of the invention 100, the tray 160 may be removable. In certain embodiments of the invention 100, the tray arm 163 may require manual repositioning (for example, by grasping the tray and pulling it around the back of the stylist chair to a new position). In some other embodiments, the motion of the tray arm 163 and tray 160 may be powered. (For example, the tray 160 may move to a new position based upon activation of a switch, dial, paddle, or other suitable interface.)

In some embodiments of the invention 100, electrical outlets (not shown in the figures) may be provided in the vicinity of the stylist chair 124 (for example, mounted on the back of the stylist chair) so that clippers, blow dryers, and other small electrical appliances may be powered. In certain embodiments of the invention 100, the electrical connection between the electrical outlets on the stylist chair and the building circuit breakers may be routed (with appropriate cable slack, cable guards, insulation, and electrical contact fingers) through or along the side of the stylist vertical motion mechanism 121 and the horizontal motion mechanism 118 to either the first mounting base 109 or the second mounting base 115 and then through the floor, so as to prevent a tripping hazard.

In certain embodiments, the second mounting base 115 may mount to the floor and may be identical or very similar in appearance to the first mounting base 109. In some embodiments, the second mounting base 115 may be wall-mounted.

Some embodiments of the invention 100 may include massage elements that are incorporated into the construction of the invention 100 in order to relax and comfort the client. For example, some embodiments might incorporate foot massage elements 170 and/or back massage elements 173. Some embodiments may provide a control panel 176 to allow the client to control the operation of massage elements at his or her discretion.

In some embodiments, safeguards (not shown in any figure) may be incorporated to prevent the motions of the chairs from causing injury to either the stylist or the client.

These may include, as non-limiting examples, hard stops at various points on the Dual Salon Styling Chair, electrical sensors and interlocks, programmatically controlled stops and interlocks provided by microprocessor software, or other similar safeguards and limitations.

Figure 2:
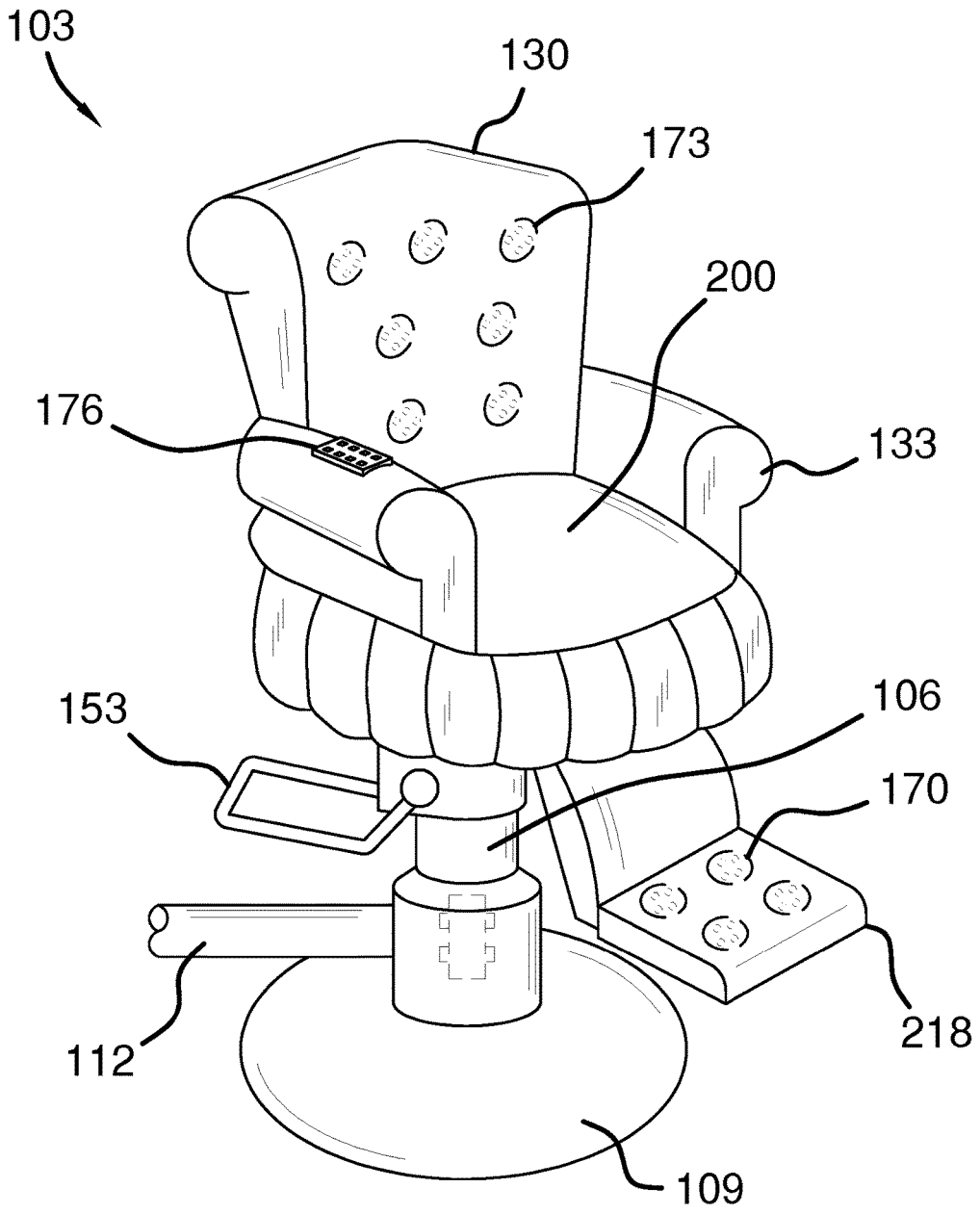
FIG. 2 is a detailed view of an embodiment of the disclosure.
Figure 3:
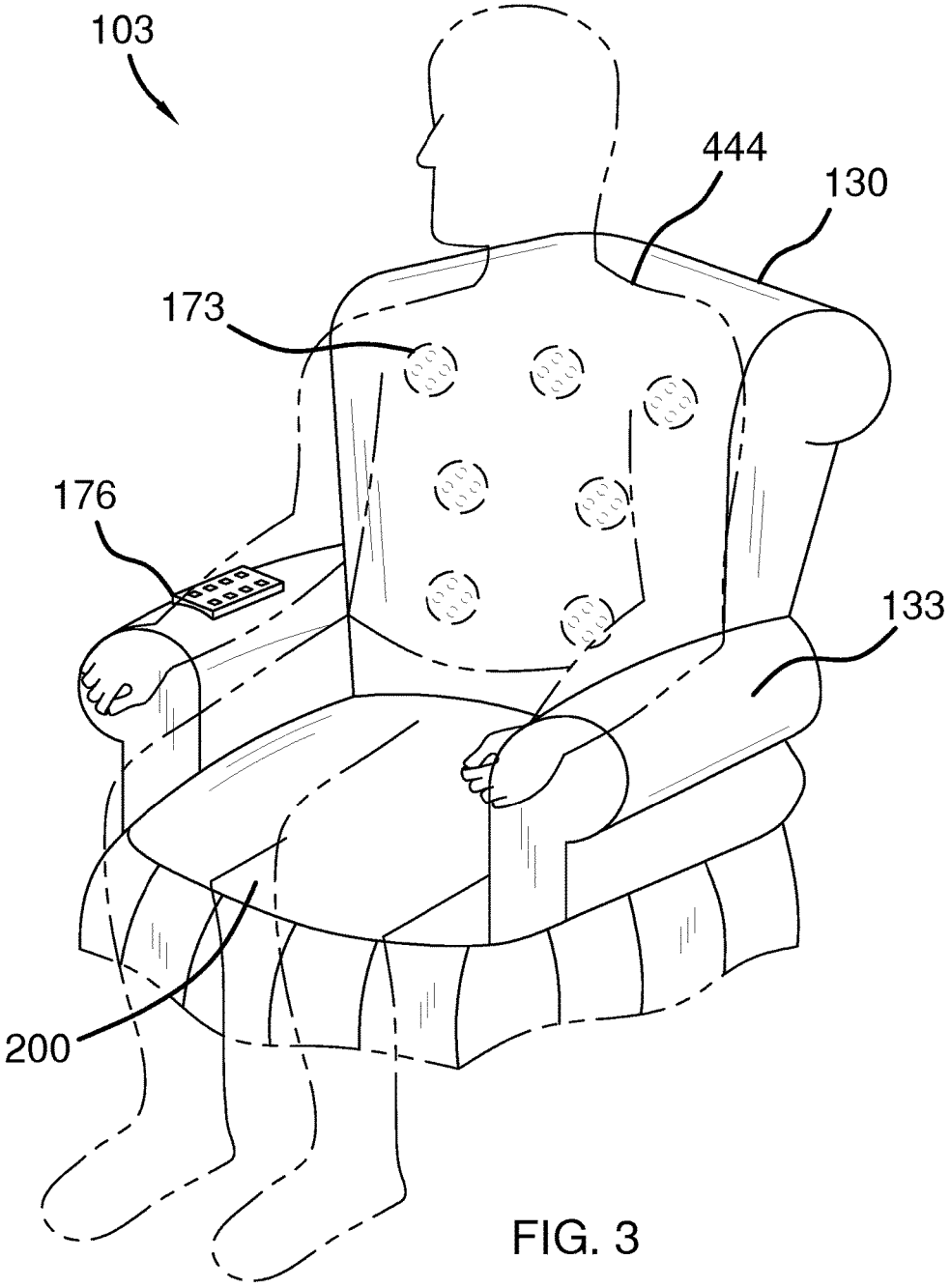
FIG. 3 is another detailed view of an embodiment of the disclosure.

Turning now to FIG. 2, a closer view of the swiveling client chair 103 is provided. In certain embodiments, the swiveling client chair 103 is mounted onto the client vertical motion mechanism 106, which in turn is mounted onto the first mounting base 109. The horizontal travel arm 112 is also attached to the first mounting base 109. In certain embodiments the back support 130 of the swiveling client chair 103 optionally includes back massage elements 173, arm supports 133, and a foot support 218, which may optionally provide foot massage elements 170.

In a particular embodiment the foot actuator 153 allows the stylist to raise and lower the swiveling client chair 103 from the stylist's seated position (not shown in FIG. 2). Some embodiments provide a control panel 176 mounted on or near the client armrest to allow client control of the foot massage elements 170 and back massage elements 173. A client seat 200 is provided, and is adapted to receive a client 444 thereon.

Figure 4:
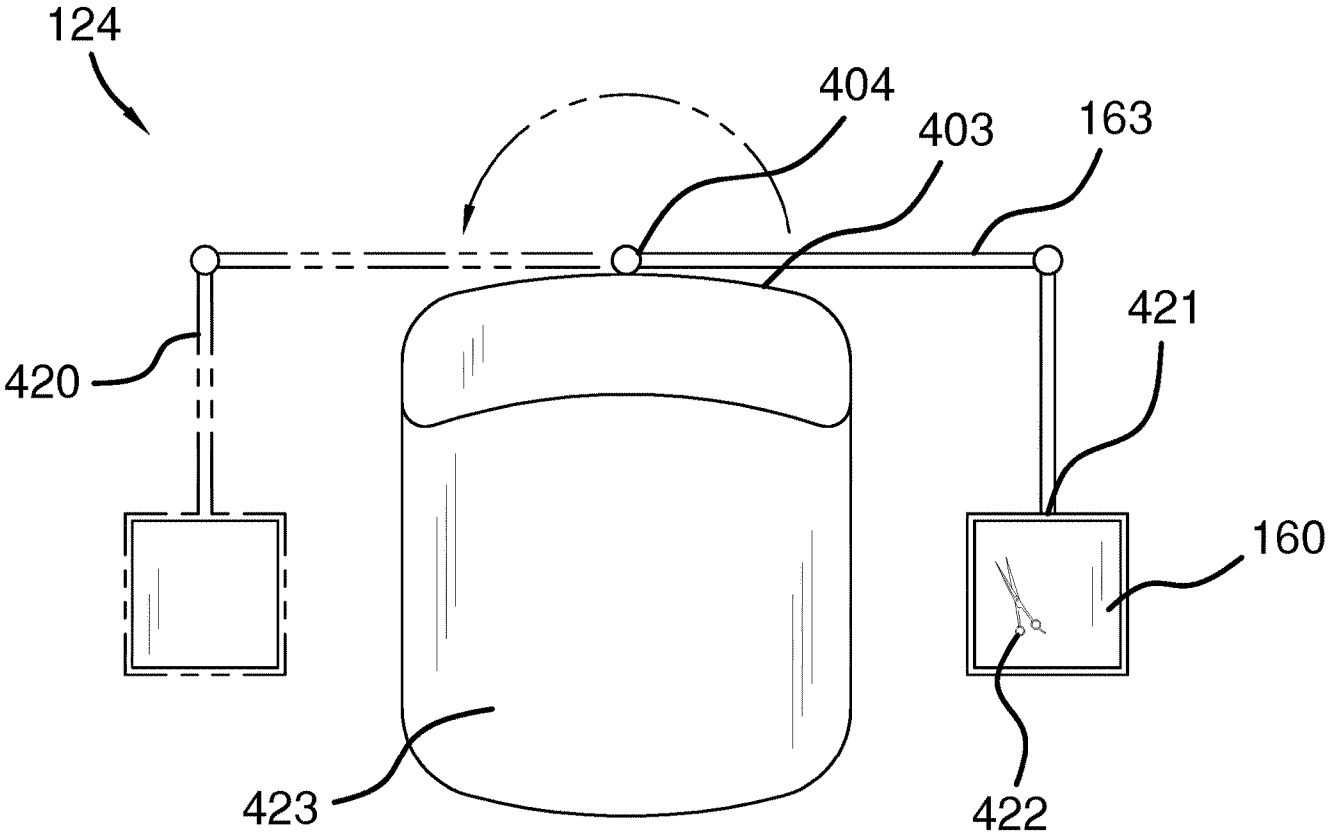
FIG. 4 is a top view of an embodiment of the stylist chair and tray.

Turning now to FIG. 4, this figure illustrates a top view of the stylist chair 124 of the invention 100. In some embodiments of the invention 100, an articulated or straight tray arm 163 attaches to a position near a back 403 or underside of the stylist chair 124. The tray arm 163 is free to swivel about a rotation point 404 so that the tray arm 163 can be moved into an alternate position 420 on the opposite side of the stylist chair 124. A distal end 421 of the tray arm 163 is attached to the tray 160, which is configured to support items 422 thereon. Said items 422 may be associated with clippers, combs, hair products, and other items that the stylist may need. The stylist chair 124 is further defined with a stylist seat 423 adapted to support a stylist 445 thereon.

It shall be noted that the primary function of the invention 100 is to support the stylist 445 on a chair in proximity with the client 444. Moreover, the stylist 445 is able to be seated adjacent to the client 444 in order for the stylist 445 to conduct whatever services whilst being seated, and as opposed to standing for a prolonged period of time. The invention 100 enables the stylist chair 124 to be moved laterally with respect to the swiveling client chair 103 such that the stylist 445 can move the stylist chair 124 out of the way when the stylist 445 wants to stand.

Figure 5:
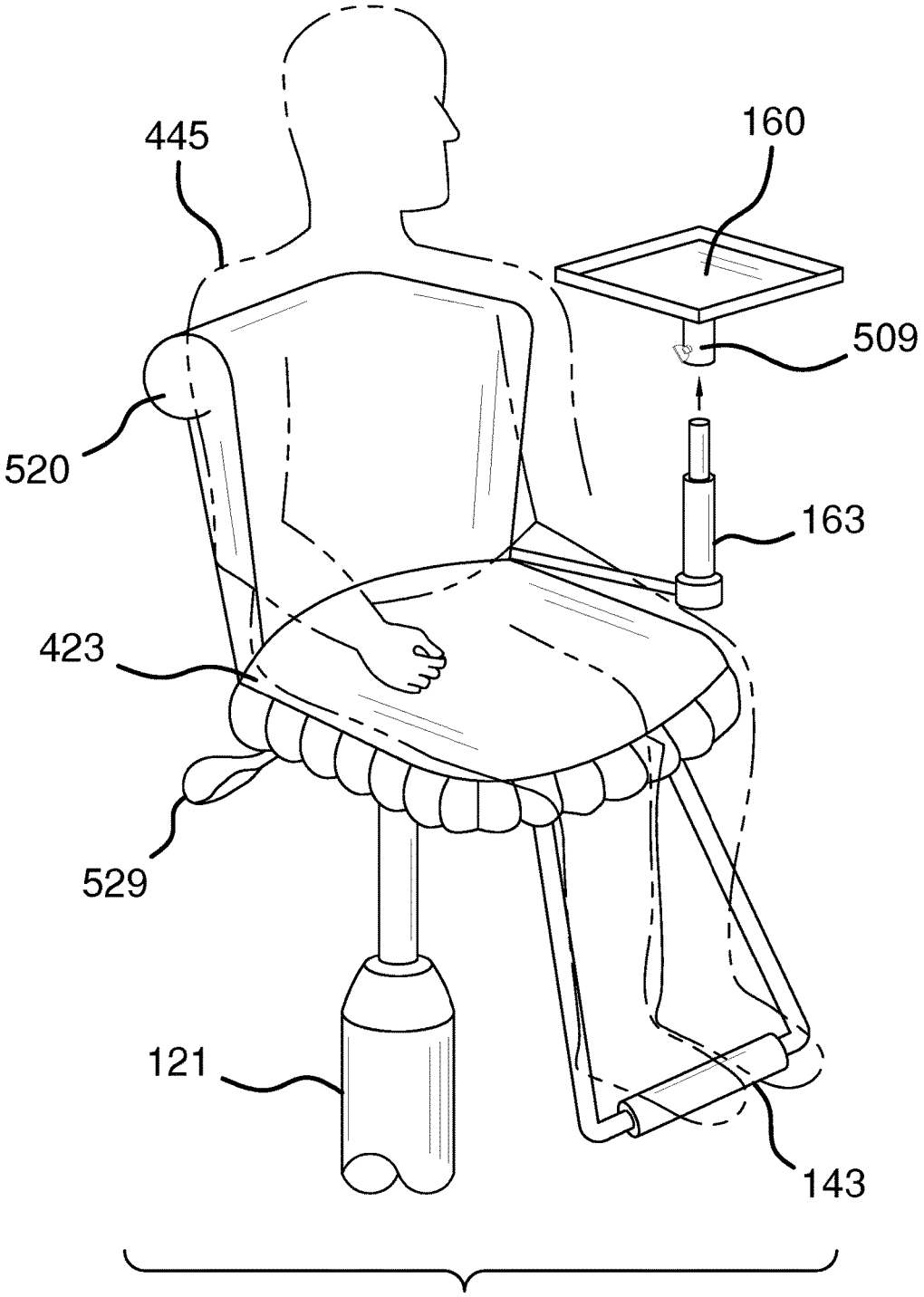
FIG. 5 is a perspective view of an embodiment of the stylist chair and illustrates removal of the tray.

Turning now to FIG. 5, this figure shows a perspective view of an embodiment of the stylist chair 124 and the tray 160. In the embodiment shown, the tray 160 is removable from the tray arm 163 via a release mechanism 509. The release mechanism 509 may use a thumbscrew. When the tray 160 is removed, some embodiments may allow the tray arm 163 to be moved to a neutral position (for example, folded flat against the back 403 of the stylist chair 124 or dropped to a position substantially below the stylist chair) so that it is out of the way. Extending down from the stylist seat 423 is the foot support 143. The stylist chair 124 includes a control paddle 529, which works with the stylist vertical motion mechanism 121 in order to adjust the elevation of the stylist chair 124.

Figure 6:
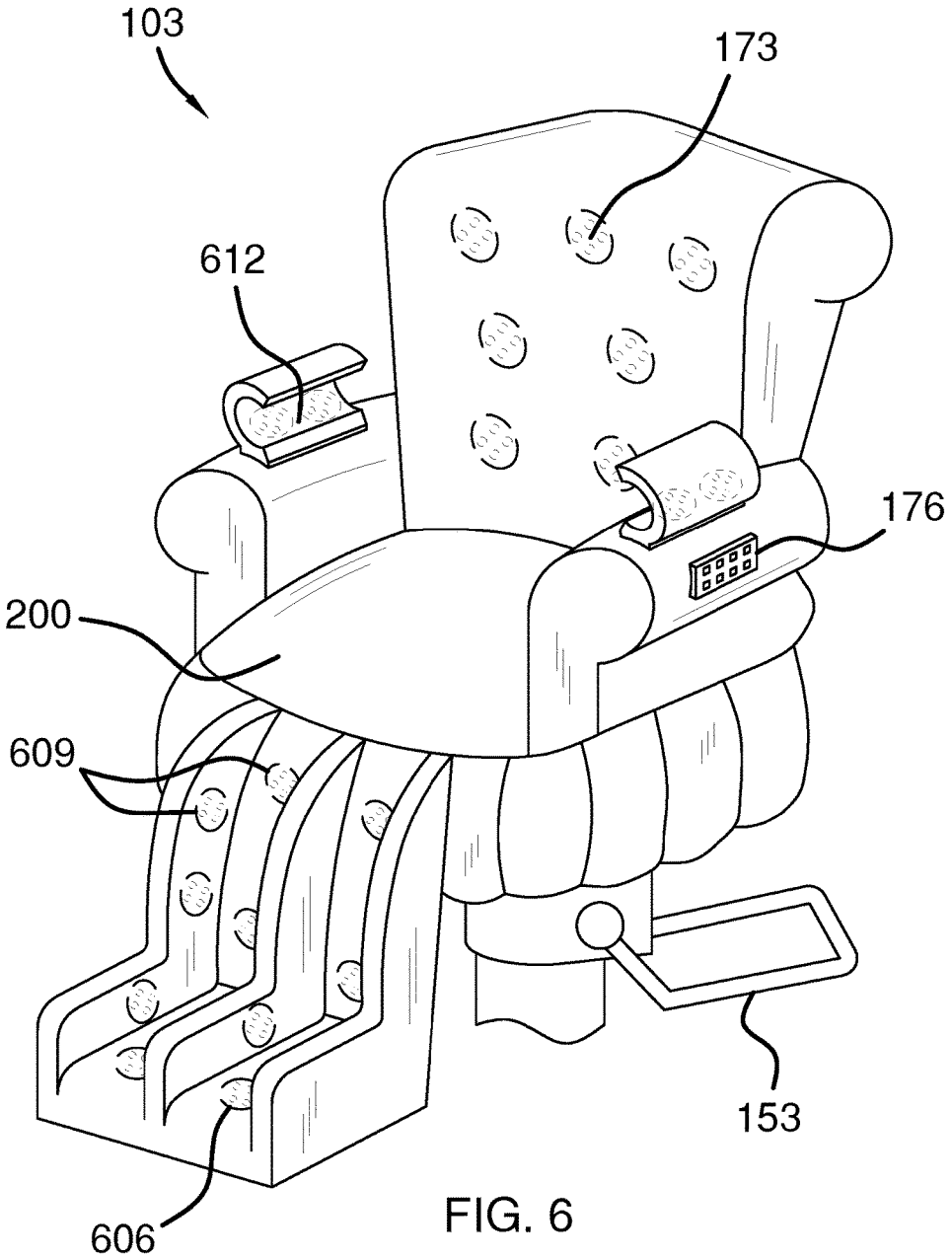
FIG. 6 is a perspective view of an embodiment of the client chair showing an alternative massage configuration.
Figure 7:
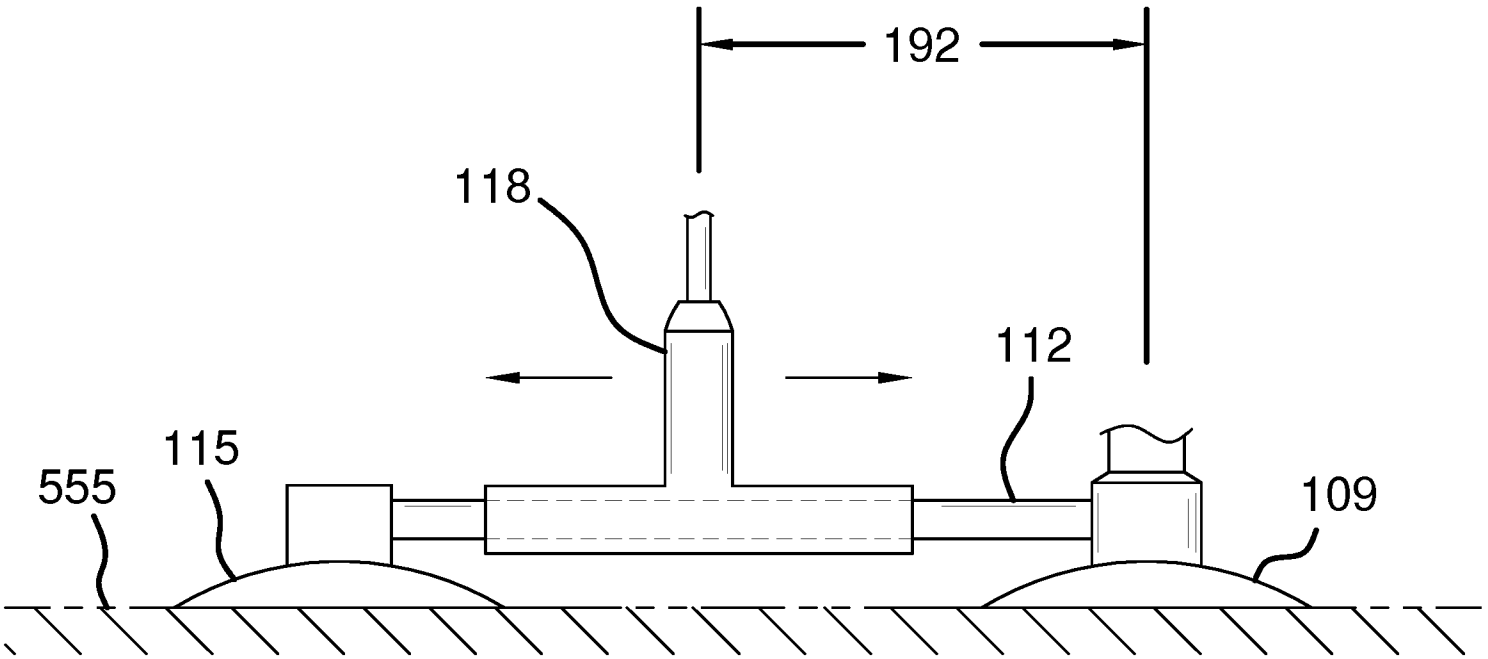
FIG. 7 is a front view of an embodiment of the disclosure.

Turning now to FIG. 6, this figure illustrates additional massage elements that may be provided in certain embodiments of the invention. Aside from the back massage elements 173 and foot massage elements 218, which have been previously described, the swiveling client chair 103 may optionally provide additional massage elements to make the client 444 feel comfortable and relaxed. For example massage elements may be provided for the legs 609 and the arms 612. Inclusion of certain message elements may require relocation of the control panel 176 to move from its previously described position on top of one of the armrests 133 to a new location (for example, the side of the arm rest as shown).

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hair-styling chair system:

a first mounting base adapted to be positioned on a support surface;

wherein a second mounting base is separate and apart from said first mounting base;

wherein a horizontal travel arm is affixed between the first mounting base and the second mounting base;

wherein a swiveling client chair is affixed to and extends upwardly from the first mounting base;

wherein a horizontal motion member is slideably engaged upon the horizontal travel arm;

wherein a stylist chair is affixed to and extends upwardly from the horizontal motion member;

wherein a client is adapted to be seated on said swiveling client chair whilst a stylist is optionally and adaptively seated on said stylist chair;

wherein the horizontal motion member adjusts a distance formed between the stylist chair and the swiveling client chair;

wherein a client vertical motion member is positioned above the first mounting base;

wherein the client vertical motion member is able to adjust an elevation of the swiveling client chair with respect to the first mounting base;

wherein the horizontal travel arm extends laterally from the first mounting base over to the second mounting base;

wherein a stylist vertical motion member extends vertically from the horizontal motion member;

wherein the stylist vertical motion member adjusts an elevation of the stylist chair with respect to the horizontal motion member;

wherein a horizontal, vertical, and angular geometry of the stylist chair relative to the swiveling client chair is adjustable via the horizontal motion member, the stylist vertical motion member, and the client vertical motion member;

wherein the swiveling client chair is able to rotate about a client axis;

wherein the stylist chair is able to rotate about a stylist axis;

wherein the swiveling client chair rotates about the client axis independent of the rotation of the stylist chair about the stylist axis;

wherein a foot actuator is included with the client vertical motion member in order to raise or lower the swiveling client chair;

wherein the swiveling client chair is further defined with a back support, armrests, and a foot support;

wherein the stylist chair is further defined with a back support, and a foot support;

wherein the stylist chair is further defined with a tray and a tray arm upon which items are adaptively placed;

wherein the tray arm is capable of swiveling from one side of the stylist chair to the other side of the stylist chair to accommodate both left and right-handed stylists.

2. The hair-styling chair according to claim 1 wherein the tray is removable.

3. The hair-styling chair according to claim 2 wherein the second mounting base is identical to the first mounting base.

4. The hair-styling chair according to claim 3 wherein foot massage elements and back massage elements are integrated into the construction of the swiveling client chair; wherein a control panel is provided to adaptively allow the client to control the operation of the foot massage elements and back massage elements.

5. The hair-styling chair according to claim 4 wherein the back massage elements are provided on the back support; wherein the foot massage elements are provided on the foot support; wherein the client seat is adapted to receive the client thereon.

6. The hair-styling chair according to claim 5 wherein the tray arm attaches to a position near a back of the stylist chair; wherein the tray arm is free to swivel about a rotation point so that the tray arm is moved into an alternate position on an opposite side of the stylist chair.

7. The hair-styling chair according to claim 6 wherein a distal end of the tray arm is attached to the tray, which is configured to support items thereon; wherein the stylist chair is further defined with a stylist seat that is adapted to support the stylist thereon.

8. The hair-styling chair according to claim 7 wherein the tray is removable from the tray arm via a release mechanism.

9. The hair-styling chair according to claim 8 wherein the stylist seat foot support, is adapted to support feet of the stylist; wherein the stylist chair includes a control paddle, which works with the stylist vertical motion mechanism in order to adjust the elevation of the stylist chair.

* * * * *